United States Patent [19]

Raikamo

[11] 4,425,861

[45] Jan. 17, 1984

[54] BOAT WITH INTERIOR ACCOMMODATION SPACE, AND STRUCTURAL PART THEREOF

[76] Inventor: Seppo Raikamo, Hakalanicatu 5, 94100, Kemi, Finland

[21] Appl. No.: 287,758

[22] PCT Filed: Dec. 22, 1980

[86] PCT No.: PCT/FI80/00014

§ 371 Date: Jul. 27, 1981

§ 102(e) Date: Jul. 27, 1981

[87] PCT Pub. No.: WO81/01823

PCT Pub. Date: Jul. 9, 1981

[30] Foreign Application Priority Data

Dec. 28, 1979 [FI] Finland ..... 794093
Apr. 17, 1980 [FI] Finland ..... 801220

[51] Int. Cl.[3] ..... B63B 29/02

[52] U.S. Cl. ..... 114/71; 114/202; 114/361

[58] Field of Search ..... 114/71, 361, 202, 201 R, 114/203

[56] References Cited

U.S. PATENT DOCUMENTS

| | | | |
|---|---|---|---|
| 2,947,277 | 8/1960 | Stevens | 114/71 |
| 3,165,762 | 1/1965 | Hage | 114/71 |
| 3,370,308 | 2/1968 | Wrenzler | 114/361 |
| 3,797,436 | 3/1974 | Moore | 114/71 |
| 4,237,809 | 12/1980 | Hickmann | 114/361 |

FOREIGN PATENT DOCUMENTS

| | | | |
|---|---|---|---|
| 612214 | 11/1948 | United Kingdom | 114/71 |

*Primary Examiner*—Trygve M. Blix
*Assistant Examiner*—C. T. Bartz
*Attorney, Agent, or Firm*—Abelman, Frayne & Rezac

[57] ABSTRACT

A sliding top for a boat includes forward and rearward portions of greater length than the spacing between a cabin and cockpit of the boat, the sliding top being movable between a forward position in which the available space of the cockpit is increased, and a rearward position in which the available space within the cabin is increased.

3 Claims, 12 Drawing Figures

BOAT WITH INTERIOR ACCOMMODATION SPACE, AND STRUCTURAL PART THEREOF

FIELD OF THE INVENTION

The present invention relates to a boat and its accommodation solutions.

The object of the invention is to make available in the boat interior accommodation spaces in greater abundance than is normal, without having to increase the boat's outer dimensions.

DESCRIPTION OF THE PRIOR ART

At present one is often compelled to end up with comparatively cramped solutions in the building of interior accommodation space, for instance in the manufacturing of sailboats and motorboats intended for family use. This has in fact the consequence that one must often, when entering the interior accommodations or within them, bow down or crawl, which detracts greatly from the comfort of boating. With a view to improving the comfort of boating, boat enthusiasts and boatmakers endeavour to build boats having the greatest possible amount of interior accommodation space.

Those solutions aim towards optimum use of the space in the boat which provide a separate stern, or long, cabin and where the attempt has been made to utilize the interior spaces of the boat with maximum sensibility. These design solutions may be considered, in the first place, to be interior fitting solutions for fixed spaces and which reduce in equivalent degree the outside spaces of the boat in the case of the sitting well (as cock-pit in sailboats).

Ample interior spaces are also aimed at in so-called family boats, where a lengthened, fixed cabin structure has been used and thereby comparatively much bunk space has been gained, but this has resulted either in great length of the boat or in a small open accommodation space.

Also such boats are known in the art which have an extensible roof portion, whereby the roofed-over space of the boat can be enlarged. Such boats have been disclosed in the U.S. Pat. Nos. 2,947,277 and 3,165,762, and in the British Pat. No. 612,214. In the U.S. Pat. No. 3,370,308 a boat is disclosed where merely the location of the roof is shifted to the bow or stern part of the boat but without thereby increasing the roofed-over volume.

Owing to the dearth of fuels and lubricants attendant on the crude oil price increase and the general increase in price of raw materials, it is not desirable to increase the size of boats, while at the same time the maximum of space is desired. One should further in boat-building be minded of the fact that no concessions of safety are conceivable.

SUMMARY OF THE INVENTION

With the boat of the invention, the advantages mentioned are gained. The structural part of the boat of the invention with cabin and outer accommodation space which comprises a roof part and which structural part is intended to be shifted in the longitudinal direction of the boat in order to change the ratio between interior and open accommodation space, is characterized by the features stated in the characteristic clause of claim 1. The features which are characteristic of a boat fitted with a structural part according to the invention have been stated in the characteristic clause of claim 3.

BRIEF DESCRIPTION OF THE DRAWINGS

The invention is described in greater detail in the following with the aid of examples, with reference to the figures of the attached drawings, where the structures have been schematically presented.

DESCRIPTION OF THE PREFERRED EMBODIMENTS

Figure 1:
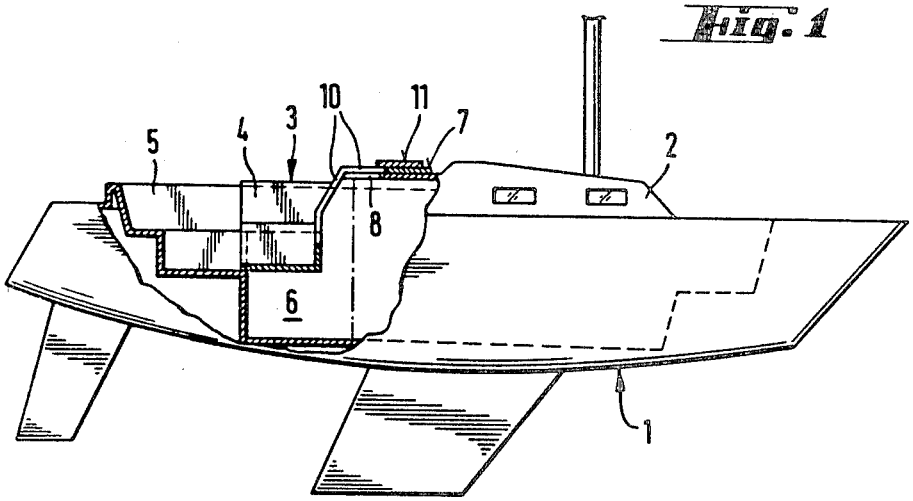
FIG. 1 presents, in elevational view and longitudinally sectioned, a boat according to the invention, with the sliding, movable part located over the cabin in the "day" position.

Referring now to FIG. 1, this displays schematically one embodiment according to the teachings of the invention. A sailboat has a hull component 1 made in conventional way, the deck structure intended to utilize the invention connecting to therewith comprising a cabin 2 and a structural part 3 of the cabin according to the invention, which part 3 is depicted in FIG. 1 in the so-called day position. The rear part 4 of the structural part 3 and the sitting well 5 of the boat constitute together the space, or the sitting well or "cock-pit" in sailboats, required for moving about in the day position, and under the rear part 4 of this structural part remains a low space 6 which is normally found in a sailboat with a fixed sitting well, cock-pit. In the day position, the structural part 3 together with the fixed part of the cabin constitutes the accommodation spaces consistent with deck structure of standard boat building. The structural part 3 and the hull component 1 of the boat have been provided with displacing rails (not depicted in the figures) and with requisite seals so that the structural component 3 can be moved sternward and bowward and in its extreme positions will be sealed against the fixed elements of the boat. An aperture 10 in the structural part 3 makes it possible to enter the space 6 through the aperture 8 of the fixed part. The aperture 10 can be closed tightly for example by the protecting roof 11.

Figure 2:
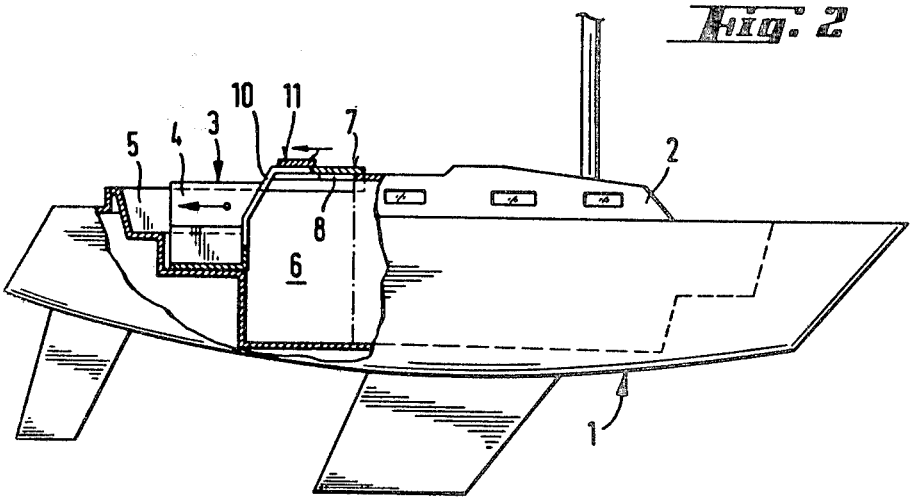
FIG. 2 presents, in elevational view and longitudinally sectioned, the same boat, with the sliding, movable part located over the open accommodation space, in the "night" position.

In FIG. 2, the structural part 3 of the boat of the example has been moved into the so-called night position. The space for operation defined by the rear portion 4 of the structural part and by the stern part 5 of the boat is curtailed to about half as the rear part of the structural part 3 relocates upon the bottom of the boat's stern part 5 into its rear position. In contrast, the interior accommodation space of the boat increases in equivalent amount, so that in the rear part of the cabin 2 is created a space 6 with full cabin height, whereby for instance the bunking and living acccommodation are quite superior to those in a conventional boat.

Figure 3:
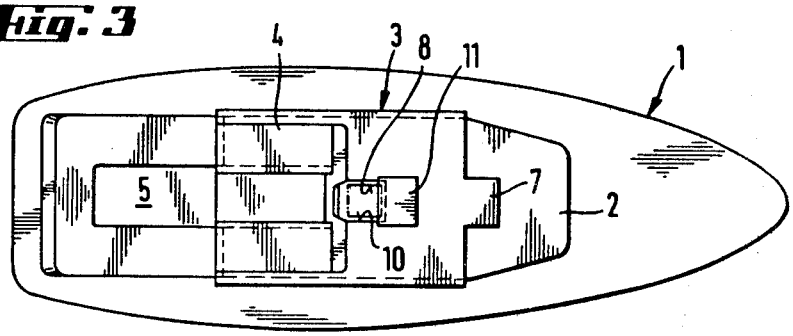
FIG. 3 presents, viewed from above, a sailboat according to the invention, with the cabin in the "day" position.
Figure 4:
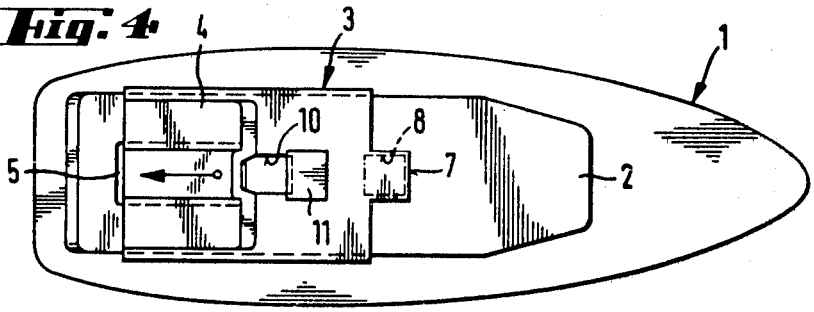
FIG. 4 presents, viewed from above, a sailboat according to the invention, with the cabin in the "night" position.
Figure 5:
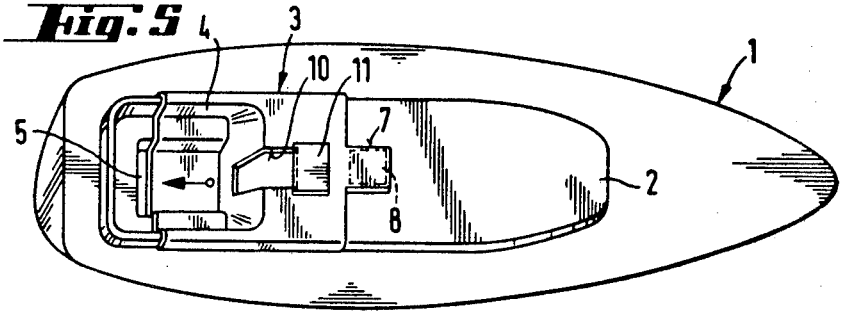
FIG. 5 presents, viewed obliquely from above, a sailboat according to the invention, with the cabin in the "night" position.
Figure 6:
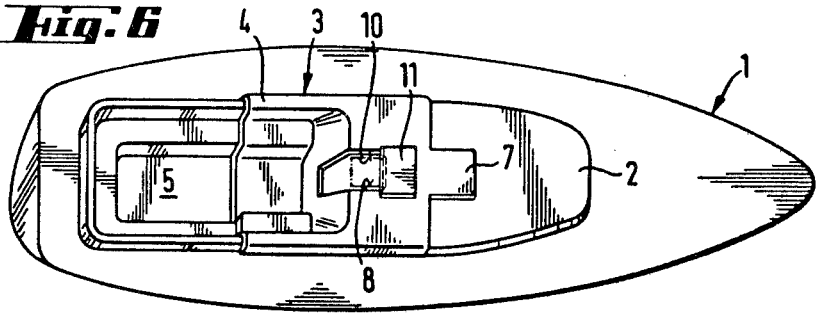
FIG. 6 presents, viewed obliquely from above, a sailboat according to the invention, with the cabin in the "day" position.

For greater perspicuity, the boat has furthermore been shown in FIGS. 3 and 4, in top view, and in FIGS. 5 and 6, viewed obliquely from above, with the cabin in the day and night positions. The figures reveal the change in the ratio of the cabin and open space volumes brought about by the movement of the structural part 3.

The front part 7 belonging to the structural part 3 covers, in the night position, the roof aperture point of the fixed part, seen as point 8, FIGS. 3, 4, 5, 6.

Although in the first place intended for sailboats, the movable structural part 3 of the cabin according to the invention, is also well appropriate for use in motorboats.

Figure 7:
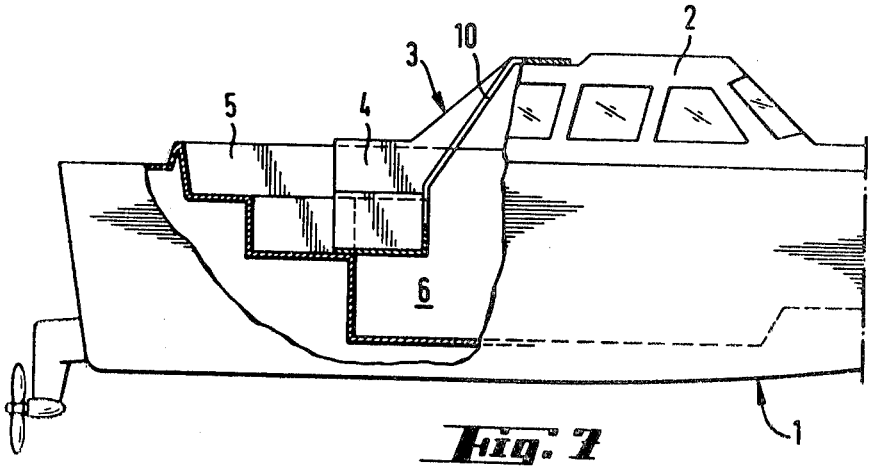
FIG. 7 presents, in elevational view and longitudinally sectioned, a motorboat according to the invention, where the cabin is in the short mode.
Figure 8:
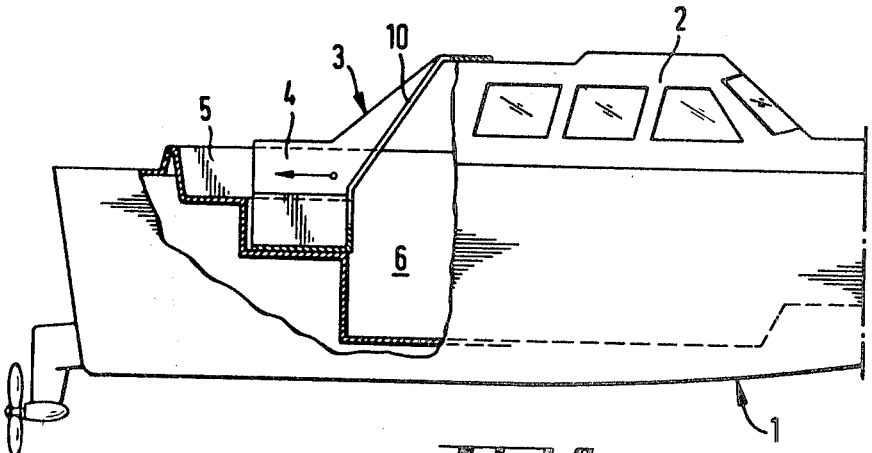
FIG. 8 presents, in elevational view and longitudinally sectioned, the same boat with the cabin in the long mode.
Figure 9:
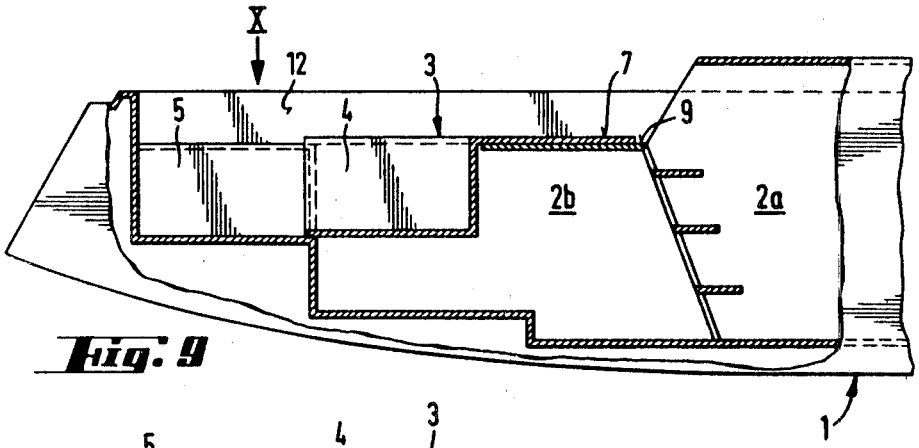
FIG. 9 presents, schematically, the stern part of still another embodiment example of the invention, in elevational view and with the sliding structural part of the boat in the "day" position.
Figure 10:
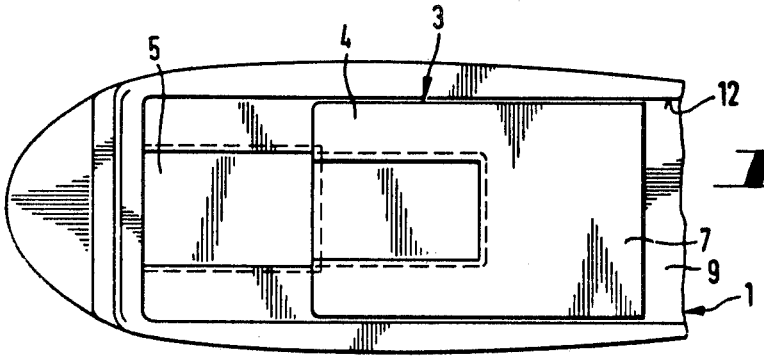
FIG. 10 shows the sitting well, so-called cock-pit in sailboats, of the same boat, viewed from above.

Therefore, FIGS. 7 and 8 illustrate an embodiment applying the invention to a motorboat. Here, the conventional hull component 1 of the motorboat has been fitted with a fixed cabin part 2 and a movable structural part 3 as taught by the invention, by the aid of which the ratio between the interior and exterior accommodation spaces of the motorboat may be changed in a manner equivalent to that in the sailboat just described. In FIG. 7, the movable structural part 3 is in its forward position, whereby the open accommodation space of the motorboat is at its maximum. In FIG. 8, the structural part 3 has been relocated into its rear position, whereby the cabin space 2 increases and, correspondingly, the outdoor space in the stern part 5 of the motorboat is reduced. It is possible in the motorboat, for instance in inclement and rainy weather, to keep the structural part 3 in its rear position, whereby the cabin space 2 will be spatious and well protected. In fair weather it is naturally more convenient to keep the structural part 3 in its forward position, whereby a more generous open space is gained.

The structure according to the invention enables, in boats which are shorter than at present, to obtain two mutually separated cabin spaces between which remains a common space, to be used e.g. as pantry and sanitary facilities. Heretofore, in a boat of equivalent length, the cabin space in the stern part remained difficult to utilize because the greater part of the space was left under the benches in the open space. Unavoidably, bunking for four persons had to be arranged in one common space without any intervening partition or isolating space. In a boat according to the invention, two couples may spend the night each in their own cabin without mutual interference. Exit is possible from the rear space through the normal access hatch, while at the same time those in the forward space may emerge, without disturbing the rear space, through the so-called sail space in the bow part, and which passage at the same time serves as emergency exit.

Depending on the construction of the boat and on the location of the cabin 2, the structural part 3 may be altered conforming to the change required; if for instance the cabin 2 is located in the stern part of the boat, as may be the case in fisher-type boats, the structural part 3 may be provided forward of the cabin 2. Likewise, if the boat is of the kind which has one cabin 2 both in the bow part and the stern part of the boat and the centre is open, the structural part 3 may be provided forward of the rear part or in the rear of the forward part, or in both locations.

It is possible by means of the said rail and seal arrangements to obtain such sealing that the self-emptying feature of the sailboat is preserved.

Since in larger boats the deck structure may constitute the roof of the cabin, the present invention has been shown in FIGS. 9–12 applied to such boats as well.

In the example of FIGS. 9–12 a boat is concerned which has a fore cabin **2*a* at the forward end of its hull 1 and an after cabin 2*b*** in the stern part. In the example a boat is shown where the fore and after cabins have been separated, but it is immaterial regarding the inventive idea how the interior accommodation spaces of the boat have been divided. The aim is merely, in a simple way, to be able to change the ratio between the interior and exterior spaces for night and day uses, for instance.

The structural part 3 designed to be tightly fixably mounted on the fixed components of the boat consists of a part 4 having the same shape as the sitting well and which in the night position fits to be located over the fixed sitting well 5. This part 4 constitutes, in the day position, the forward part of the sitting well 5. The structural part 3 is here mounted in a recess 12 to cover the opening which has been made to the deck structure of the boat so that the structural part 3 when moved to the "night" position enlarges the cabin space 6 and when moved to the "day" position enlarges the open space, for example cock-pit in the sail boats.

Figure 11:
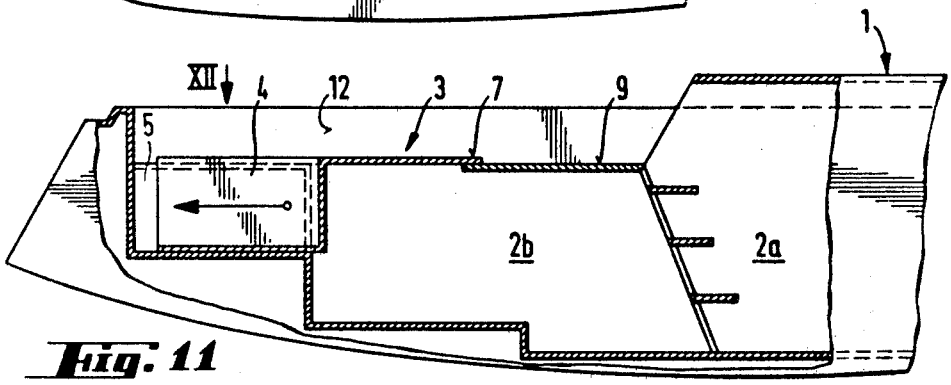
FIG. 11 presents the stern part of the boat of FIG. 9 schematically, and shown with the sliding structural part in the "night" position. The figure shows the boat in sectioned elevational view.
Figure 12:
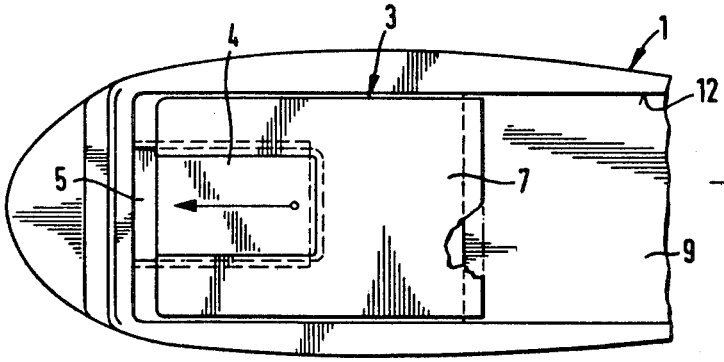
FIG. 12 presents the sitting well of FIG. 11, the "night" position, viewed from above.

The forward part 7 of the structural part 3 is in FIGS. 11 and 12 an extension to the deck 6 and acts therefore as roof for the after cabin **2*b* when the structural part 3 is in the "night" position. The deck or bridge 6 of the boat's stern part extends rearward with the aid of the forward part 7 of the structural part 3, and at the same time the rear part of the after cabin 2*b*** attains its full height. At night and during inclement weather, this expansion of the after cabin gains great significance through improved comfort of use.

Between the leg space in the sitting well 5 and the cabin **2*b*** there is left in the boat a broader seat and/or a deck portion, which is covered by the equivalent seat and/or deck portion, depending on the location of the sliding structural part.

In larger boats, the below-decks height is sufficient even without a higher cabin structure. However, the leg space in the sitting well of the outside space becomes an obstacle to the use of the space below decks at full height. With the aid of the invention the detriment arising to the interior space from the leg space in the sitting well can be eliminated.

The invention is appropriate to be applied both in sailboats and in motorboats. It is usable on all kinds of boats which have sufficient height to be employed as taught by the invention.

The solution of the invention in question affords the advantage that the interior spaces of the boat can be utilized better than heretofore. The capacity, in a boat according to the invention, of the available interior spaces compared with those available in existing, equivalent-sized boats is more favourable. The invention affords more ample interior space at lower cost, yet without need to reduce the open space which is available as needed.

Moreover, when applying in the case of sailboats the sliding, movable structural part of the invention, one achieves a more favourable than normal weight distribution in the boat during sailing, and this adds to the safety of sailing.

It is possible with the aid of the said rail and seal arrangements to obtain a sealing such that the interior spaces obtained with the aid of the structural part are equal in quality, as regards warmth for instance, to the fixed interior spaces of the boat and, as said before, the self-emptying feature of the boat can be preserved.

The manufacturing of a boat according to the invention is possible in series production, in fact so that the boat's components are separately manufactured, whereupon the boats may be assembled, and this renders possible an industrial production of the boat and of the structural part. Structural parts may also be made for boats already in use, whereby an improvement of their space use becomes possible. Then a part of the deck structure of the boat is removed in order to adjust the structural part 3.

In the figures of the drawings a few embodiments of the idea of the invention have been presented. But the invention may be modified within the scope defined by the claims, for instance exactly in accordance with the intended use of each boat. The seals for the structural part may also be prepared to conform to the way in which the relocatement from one position to the other is executed. In FIGS. 9–12 a design has been shown where the roof of the after cabin is not the boat deck level with the boat's board. This has, however, been referred to as the boat's deck in the disclosure because it is immaterial from the viewpoint of the invention whether the roof of the interior space consists of the deck structure proper of the boat, or of a lower bridge structure covering the interior space, as long as the interior space has sufficient height for being used in the way implied by the invention. The outside accommodation space of the boat has been referred to as the sitting well or cock-pit, but it may as well be any other open space, which may indeed be the case in connection with working boats. The construction as taught by the invention causes little increase of the price of the boat, while it increases considerably the value in use of the boat's accommodation spaces.

I claim:

1. A sliding top for a boat of the type including a cabin and a cockpit spaced from said cabin, the sliding top including:

a first portion having roof and sidewall portions arranged in telescoping relationship with roof and sidewall members of said cabin;

a second portion integral with said forward portion and having deck and sidewall portions arranged in telescoping relationship with deck and sidewall members of said cockpit;

said first and second portions of said sliding top each having a length greater than the spacing between said cabin and said cockpit; and slide means permitting movement of said sliding top between:

(a) a first position in which said second portion is telescoped relatively to said cockpit deck and sidewall members and said first portion provides an extension of said cabin roof and sidewall members; and, (b) a second position in which said first portion is telescoped relatively to said cabin roof and sidewall members and said second portion provides an extension of said cockpit deck and sidewall members.

2. The sliding top of claim 1, including sealing members interposed between said first portion and said cabin roof and sidewall members, and interposed between said second portion and said cockpit deck and sidewall portions.

3. The sliding top of claim 1, including a transverse wall portion integral with said first and second portions, and, movable in unison therewith.

* * * * *